US010260253B2

(12) United States Patent
Moon

(10) Patent No.: US 10,260,253 B2
(45) Date of Patent: Apr. 16, 2019

(54) DOOR TRIM ASSEMBLY WITH CLUTCH MECHANISM

(71) Applicant: TOWNSTEEL, INC., City of Industry, CA (US)

(72) Inventor: Charles W. Moon, Colorado Springs, CO (US)

(73) Assignee: Townsteel, Inc., City of Industry, CA (US)

( * ) Notice: Subject to any disclaimer, the term of this patent is extended or adjusted under 35 U.S.C. 154(b) by 307 days.

(21) Appl. No.: 15/047,521

(22) Filed: Feb. 18, 2016

(65) Prior Publication Data

US 2016/0298358 A1 Oct. 13, 2016

Related U.S. Application Data

(60) Provisional application No. 62/145,455, filed on Apr. 9, 2015, provisional application No. 62/145,460, filed on Apr. 9, 2015.

(51) Int. Cl.

| | |
|---|---|
| ***E05B 13/00*** | (2006.01) |
| ***E05B 15/02*** | (2006.01) |
| ***E05B 15/04*** | (2006.01) |
| ***E05B 47/06*** | (2006.01) |
| *E05B 47/00* | (2006.01) |

(52) U.S. Cl.

CPC ..... *E05B 13/004* (2013.01); *E05B 15/02* (2013.01); *E05B 15/04* (2013.01); *E05B 47/0692* (2013.01); *E05B 47/0012* (2013.01); *E05B 2015/0448* (2013.01); *E05B 2047/0031* (2013.01)

(58) Field of Classification Search

CPC ..... Y10T 292/57; Y10T 292/1021; Y10T 70/5823; Y10T 292/1014; Y10T 477/32; E05B 47/0012; E05B 2047/0026; E05B 65/1086; E05B 2047/0053; E05B 81/46

See application file for complete search history.

(56) References Cited

U.S. PATENT DOCUMENTS

| | | | | |
|---|---|---|---|---|
| 5,640,863 | A | 6/1997 | Frolov | |
| 5,857,365 | A | 1/1999 | Armstrong | |
| 6,012,310 | A | 1/2000 | Hsiao | |
| 6,062,612 | A * | 5/2000 | Lin | E05B 47/0012 292/142 |
| 6,216,502 | B1 | 4/2001 | Cannella et al. | |
| 6,406,072 | B1 | 6/2002 | Chen | |
| 6,471,257 | B1 | 10/2002 | Lu et al. | |

(Continued)

*Primary Examiner* — Mark A Williams

(74) *Attorney, Agent, or Firm* — Eric W. Cernyar

(57) ABSTRACT

A door trim assembly comprises a handle coupler, spindle driver, clutch, motor, and clutch driver assembly. The clutch is configured to selectively engage and disengage the handle coupler to the spindle driver. When engaged, the spindle driver rotates with the handle. When disengaged, the handle rotates freely of the spindle driver. The clutch driver assembly includes an escapement spring positioned coaxially with the motor shaft and held between first and second spring seats. A motor is operable to rotate the first spring seat. The second spring seat carries a pin or cam to operate the clutch and is biased by legs of the escapement spring to rotate with the motor. If the second spring seat is blocked from rotating, then rotation of the first spring seat winds the escapement spring.

20 Claims, 15 Drawing Sheets

(56) References Cited

U.S. PATENT DOCUMENTS 6,487,884 B1 * 12/2002 Constantinou ..... E05B 47/068 70/277
6,517,127 B1 2/2003 Lu et al.
6,591,643 B1 7/2003 Cannella et al.
6,598,909 B2 7/2003 Lu
6,725,693 B2 4/2004 Yu et al.
6,851,291 B2 * 2/2005 Nunez ..... E05B 47/0673 70/150
6,895,791 B2 * 5/2005 Alexander ..... E05B 47/0669 192/223.1
7,007,526 B2 * 3/2006 Frolov ..... E05B 47/068 70/107
7,096,698 B2 * 8/2006 Walsh, III ..... E05B 47/0012 70/149
7,188,495 B2 * 3/2007 Errani ..... E05B 47/0692 70/218
7,308,810 B2 12/2007 Menta San Miguel
8,201,858 B1 6/2012 Moon et al.
8,292,336 B2 10/2012 Moon
8,419,086 B2 4/2013 Moon
8,424,935 B2 4/2013 Moon
8,621,900 B2 1/2014 Wu et al.
8,783,076 B2 * 7/2014 Schwenk ..... E05B 47/0688 70/277
8,844,330 B2 9/2014 Moon et al.
9,033,375 B1 5/2015 Moon et al.
9,394,722 B2 7/2016 Moon et al.
9,528,300 B2 12/2016 Moon et al.
2001/0005998 A1 7/2001 Imedio Ocana
2004/0040353 A1 * 3/2004 Yu ..... E05B 47/068 70/107
2006/0112747 A1 6/2006 Moon et al.
2011/0079057 A1 * 4/2011 Frolov ..... E05B 47/0673 70/91
2014/0250956 A1 9/2014 Chong
2016/0094103 A1 * 3/2016 Lien ..... H02K 5/10 292/336.3

* cited by examiner

DOOR TRIM ASSEMBLY WITH CLUTCH MECHANISM

RELATED APPLICATIONS

This application claims the benefit of U.S. Provisional Patent App. Nos. 62/145,455 and 62/145,460, both filed Apr. 9, 2015, which are herein incorporated by reference for all purposes.

FIELD OF THE INVENTION

This invention relates generally to door latching assemblies, and more particularly, to door latching assemblies that use a clutch to engage a door handle to a latch-retracting spindle.

BACKGROUND

There are many factors and constraints that influence designs of lock and trim assemblies, including whether a clutch mechanism or a stop mechanism is employed to lock the door, the number of lock functions supported, the strength of the lock, the ability of the lock to thwart an attack, and the cost of manufacture. Each design constraint compounds the complexity of such a design, because attempting to accommodate a given design constraint may restrict one's ability to accommodate a different design constraint. Because not all designs are equally effective or practical, and because changing circumstances continually give rise to new design constraints, there is always a need for innovation.

For example, when choosing a replacement trim assembly for a door, it is important to find a trim assembly that is compatible with the spindle and possibly other elements of the interior latching assembly, that matches the door function (e.g., is it an interior door or an exit door), that is compatible with the handedness of the door, that matches the physical dimensions and relative placement of the mortise and/or bore cylinder, and that matches the physical arrangement of trim mounting holes.

Most trim assemblies, however, are only suitable for a specific type or make of lock. It would be advantageous to have a universal trim assembly that, with minimal substitution or rearrangement of parts, accommodates a wide variety of types and makes of locks, as well as a wide variety of lock functions. However, the design of such an assembly is complicated by the typically tight spacing of trim assembly components. For example, a rearrangement of the trim mounting posts may require a rearrangement of other trim assembly components.

As another example, it is desirable to design a lock in a manner that thwarts attempts to defeat it. One common method of attack is to apply a crowbar or long wrench to the door handle or lever. Another method of attack is to apply a powerful blow to the door or trim assembly. Yet another method of attack is to manipulate internal steel components of the lock using a strong magnet.

As yet another example, many lock mechanisms require a door handle to be in a neutral, non-latch-retracting position in order to lock the handle. It is therefore advantageous for the trim assembly to incorporate a return spring to bias the handle back to the neutral position and an escapement spring to engage the lock when the handle returns to the neutral position.

U.S. Patent Publication No. 2001/0005998 A1 describes a clutch mechanism for an electronic lock in which a motor drives an endless screw which in turn drives a spring connected to a lever of a yoke that engages and disengages a clutch element. The clutch mechanism may be susceptible to tampering. For example, an impact might cause the clutch to become engaged, allowing an intruder to break in.

Improved clutch-type trim assemblies are needed that can be applied to a greater number of pre-existing existing latch assemblies, that support latch retraction through lever rotation in either direction from a neutral position, and that are better able to thwart an attack.

The present invention described below can be characterized in many different ways, not all of which are limited by its capacity to address the above-mentioned issues, needs or design constraints.

SUMMARY

A door trim assembly for operating a door latch using a clutch mechanism is provided. Characterized one way, the door trim assembly comprises a handle coupler, a spindle driver, a clutch, a motor, and a clutch driver assembly. The handle coupler is configured to be coupled to and rotated with the door handle/lever. The clutch is configured to selectively engage and disengage the handle coupler to the spindle driver. When engaged, the spindle driver rotates with the handle coupler. When disengaged, the handle coupler rotates freely of the spindle driver. The clutch driver assembly is operated by the motor to drive the clutch between engaged and disengaged configurations. The clutch driver assembly includes an escapement spring positioned coaxially with the motor shaft. The clutch driver assembly is operable to store energy in the escapement spring when the clutch is blocked from transitioning between engaged and disengaged positions.

In one embodiment of the clutch driver assembly, opposite legs straddle a spring leg saddle and a tab that rotate about a common axis with the motor shaft. In a non-escapement condition, the spring leg saddle is aligned with tab and the clutch driver assembly is operable to rotate the spring leg saddle synchronously with the tab. In an escapement condition, the tab is blocked from rotating, and the clutch driver assembly is operable to rotate the spring leg saddle away from the tab, thereby winding up the spring.

Also, one embodiment of the clutch driver assembly includes a carousel that turns a pin or cam to operate the clutch. The motor is operable, when the clutch is disengaged, to lock the carousel in a disengaged configuration. The clutch driver assembly is also configured to store energy in the escapement spring when the carousel is blocked from rotating, and to release energy from the escapement spring by rotating the carousel.

Characterized another way, the door trim assembly comprises a handle coupler, a spindle driver, and a clutch—all as above—along with another embodiment of a clutch driver assembly that is operable to lock the clutch in an engaged position. The clutch driver assembly locks the clutch in an engaged position by positioning a driver (e.g., an offset pin or cam) connected to the clutch a maximum distance from the outside face of the escutcheon. The clutch driver assembly locks the clutch in a disengaged position by positioning the driver a minimum distance from the outside face of the escutcheon. Shock delivered to the face of the door and along a normal axis to the door is unlikely to compromise the clutch because the driver is positioned at the 3 o-clock or 9 o-clock positions. The driver can only move along a normal axis to the door if it also moves up and down vertically along a circular arc connecting the 3 o-clock and 9 o-clock positions.

Characterized in yet another way, the door trim assembly comprises a handle coupler, spindle driver, and clutch—all as described above—along with another embodiment of a motor-operated clutch driver assembly. The motor-operated clutch driver assembly comprises an escapement spring mounted between first and second spring seats. A motor is operable to rotate the first spring seat. The second spring seat, which is coupled to the clutch, is biased by legs of the escapement spring to rotate with the motor and thereby operate the clutch. The first spring seat is operable to wind the escapement spring when the second spring seat is blocked.

In one embodiment, a pin or cam is eccentrically positioned on the second spring seat, the pin or cam operating to convert rotary motion of the second spring seat into substantially linear movement of the clutch.

In another embodiment, a pivot arm is pivotally mounted to the escutcheon. The pivot arm includes an arcuate rail configured to carry a connecting link and guide the connecting link for radial movement along the arcuate rail. The connecting link is also configured for axial movement between a clutch-engaging position and a clutch-disengaging position. In the clutch-engaging position, the connecting link bridges slots in the spindle driver and handle coupler, and wherein in the clutch-disengaging position, the connecting link is retracted so that it does not bridge the two slots.

The offset pin, pivot arm, and escapement spring are respectively arranged so that if the spindle driver rotates from a position in which the spindle driver slot is not aligned with the connecting link to a position in which the spindle driver slot is aligned with the connecting link, the biasing of the escapement spring pushes the connecting link into the spindle driver slot.

In one embodiment, the handle coupler comprises a disk mounted for coaxial rotation with the spindle and a guide or slot for linearly guiding a clutch member in an axial direction between a first position closest to an outside face of the escutcheon and a second position farthest from the outside face of the escutcheon. The spindle driver has a guide or slot operable to be aligned with the guide or slot of the handle coupler and receive a connecting link to engage the spindle driver to the handle coupler.

These and other aspects and advantages of the embodiments disclosed herein will become apparent in connection with the drawings and detailed disclosure that follows.

Figure 1:
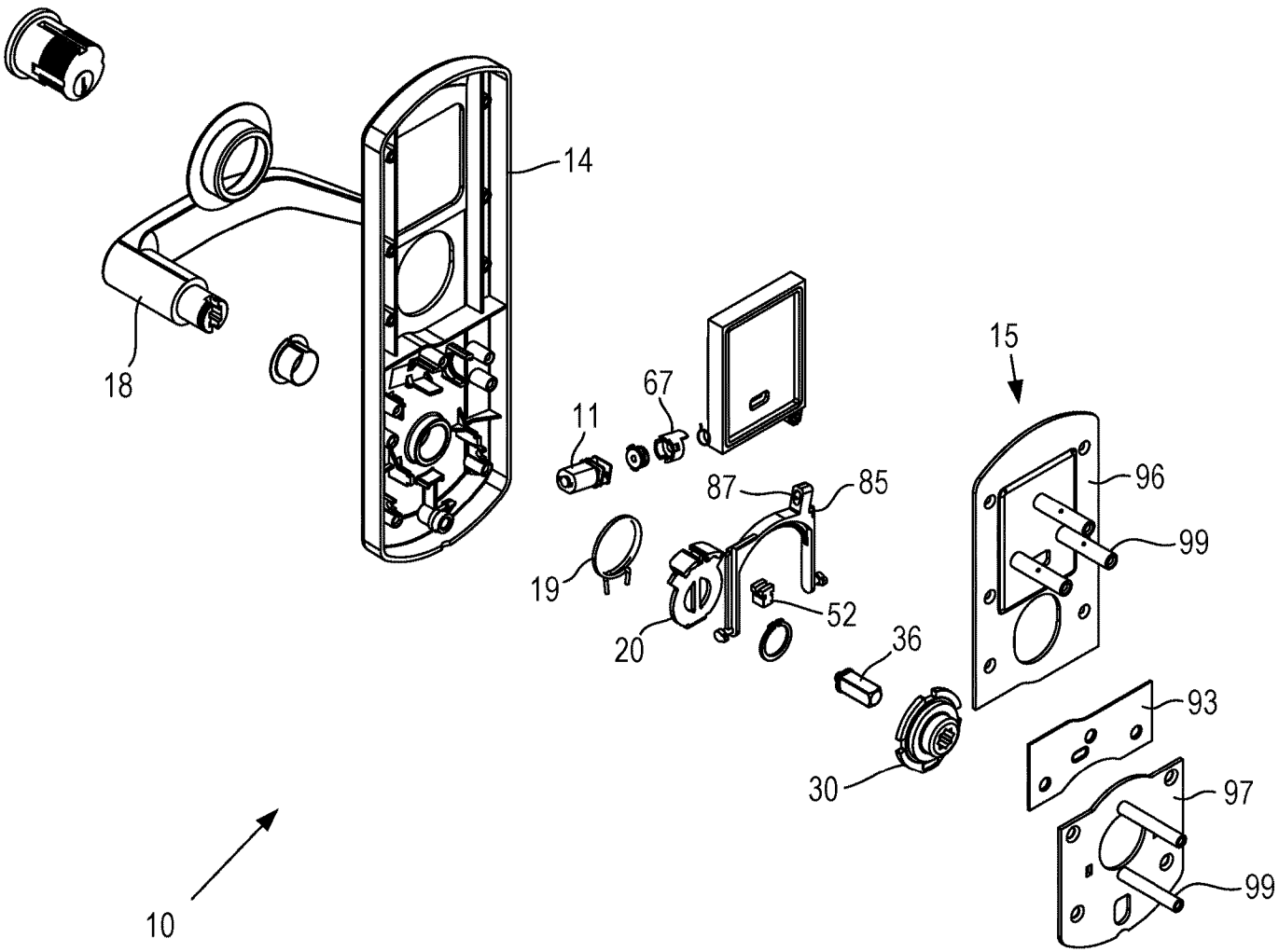
FIG. 1 is an exploded view of one embodiment of a lock trim assembly.
Figure 2:
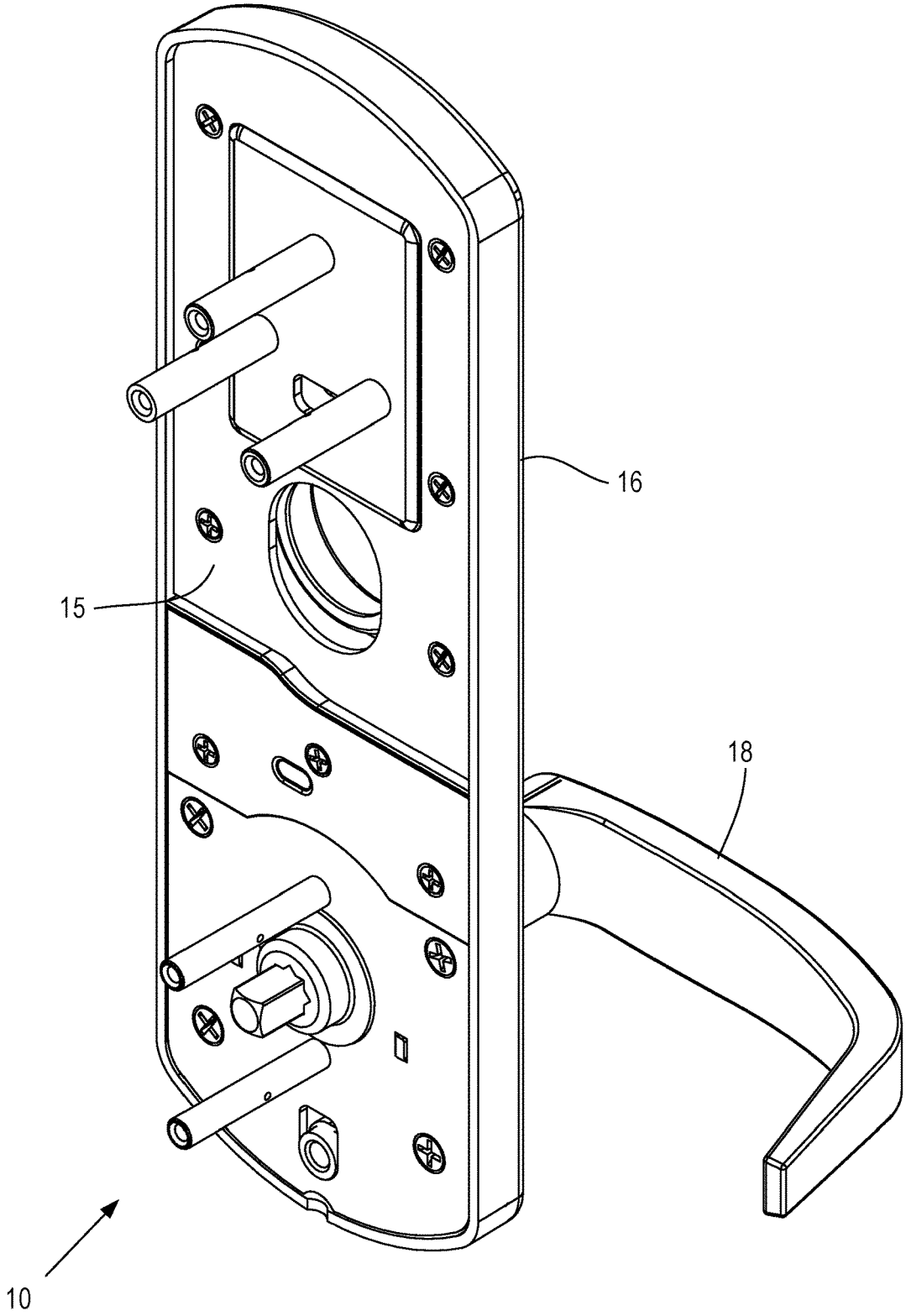
FIG. 2 is a perspective view of the lock trim assembly of FIG. 1, when assembled.
Figure 3:
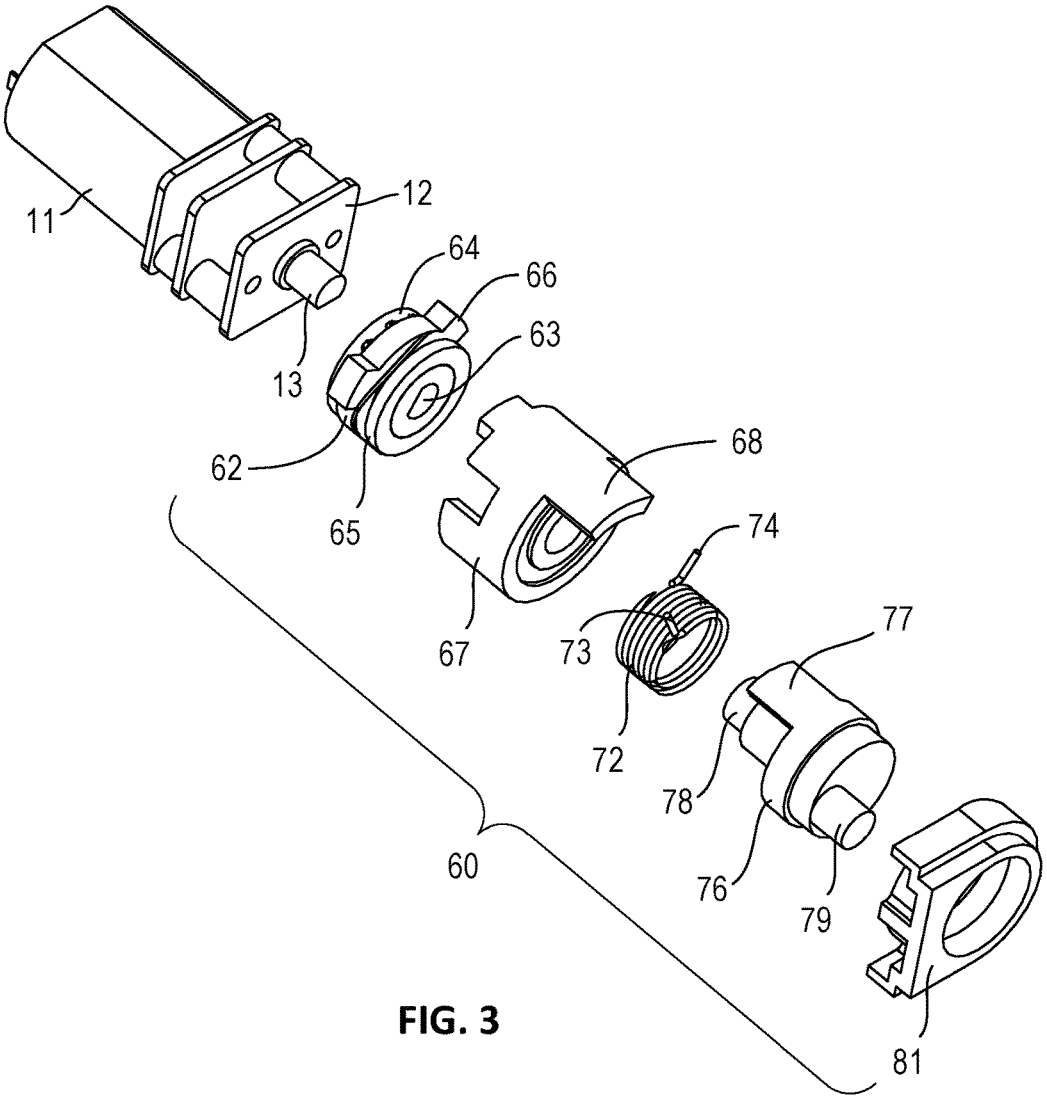
FIG. 3 is an exploded view of the clutch driver assembly.
Figure 4:
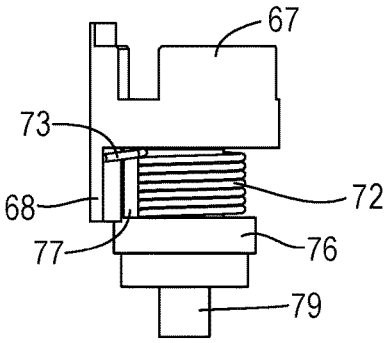
FIG. 4 is a side view of the clutch driver assembly, when assembled, an in a non-escapement condition.
Figure 5:
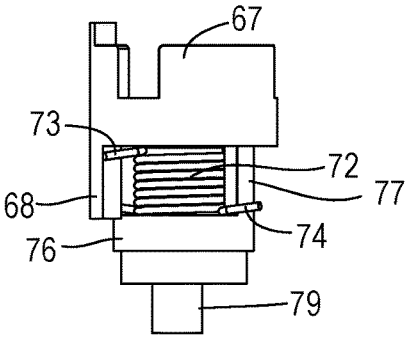
FIG. 5 is a side view of the clutch driver assembly in an escapement condition.

These and other aspects and advantages of the embodiments disclosed herein will become apparent in connection with the drawings and detailed disclosure that follows.

DETAILED DESCRIPTION

FIGS. 1-19 illustrate various embodiments of a trim assembly 10. In describing preferred and alternate embodiments of the technology described herein, as illustrated in FIGS. 1-21, specific terminology is employed for the sake of clarity. The invention is not intended to be limited to the specific terminology so selected, but rather to be construed liberally in the context of this specification. The invention described herein, moreover, should be understood to incorporate all technical equivalents that operate in a similar manner to accomplish similar functions.

The trim assembly 10 comprises a coupling assembly 25—for example, a handle coupler 20, a spindle driver 30, and a clutch 50 operative to selectively engage and disengage the handle coupler 20 to the spindle driver 30—that transfers load from a door handle 18 to a spindle 36. The use of the spindle driver 30 in conjunction with the handle coupler 20 not only facilitates the use of a clutching mechanism, but also enables the trim assembly 10 to be adapted to a variety of different spindles with minimal substitution of parts. The spindle driver 30's eight-pronged opening 39 accommodates both spindles 36 that are square and spindles 36 that are diagonally oriented when in the neutral, non-latch-retracting position. If the internal latching assembly has a larger or smaller spindle diameter, the trim assembly 10 can be adapted to the spindle 36 simply by swapping out the spindle driver 36 for one with an appropriate-sized spindle aperture.

The trim assembly 10 also comprises a return spring 19 and a motor 11 that drives a clutch driver assembly or transmission 60 to operate the clutch 50. The spindle 36 extends into a door cavity that houses a latch assembly (not shown), for example, a cylindrical trim assembly or a mortise trim assembly. Rotation of the spindle 36 is operative to retract the latch (not shown).

The trim assembly 10 also comprises an escutcheon 14 and a back plate assembly 15 that is mounted to the face of the door. Advantageously, the back plate assembly 15 allows trim mounting posts 99 to be mounted to the trim assembly 10 in a variety of arrangements, to accommodate a variety of existing borehole and trim mounting hole arrangements, without interfering with the motor 11, driver assembly 60, and escapement assembly 70 (original): In the embodiment shown, the back plate assembly 15 comprises an upper plate or deadbolt plate 96, a mid plate 93 positioned over the motor 11, driver assembly 60, and escapement assembly 70, and a bottom plate or spindle plate 97 (original): Posts 99 can be mounted to the plates 93, 96, and 97 wherever necessary to adapt the trim assembly to any of a variety of configurations of trim mounting holes on an existing door. Examples of different post mounting positions are depicted and described my application Ser. No. 15/047,540, filed on Feb. 18, 2016, and entitled "Motorized Lock and Trim Assembly," which application is herein incorporated by reference for all purposes. Also advantageously, the trim assembly 10 is configured and arranged in a manner that shares much in common with that application. Many of the components are the same or substantially the same. The back plate assembly 15 and spindle driver 30, for example, are the same. The same handle 14 may be used. The escutcheon 14, for example, is the same except for a few stamped parts. The commonalities between the locks reduce the cost of manufacture and allow for a more uniform set of instructions in assembling either trim assembly to a door.

The motor 11, handle coupler 20, clutch 50 and most of the spindle driver 30 are contained between the escutcheon 14 and the back plate assembly 15. The handle coupler 20 is configured to be coupled to and rotated with a door handle/lever 18. A return spring 19 biases the handle 18 toward a neutral, non-latch retracting orientation. In one embodiment, the handle 18 can be operated in either direction from the neutral, non-latch retracting orientation to retract the latch.

Figure 6:
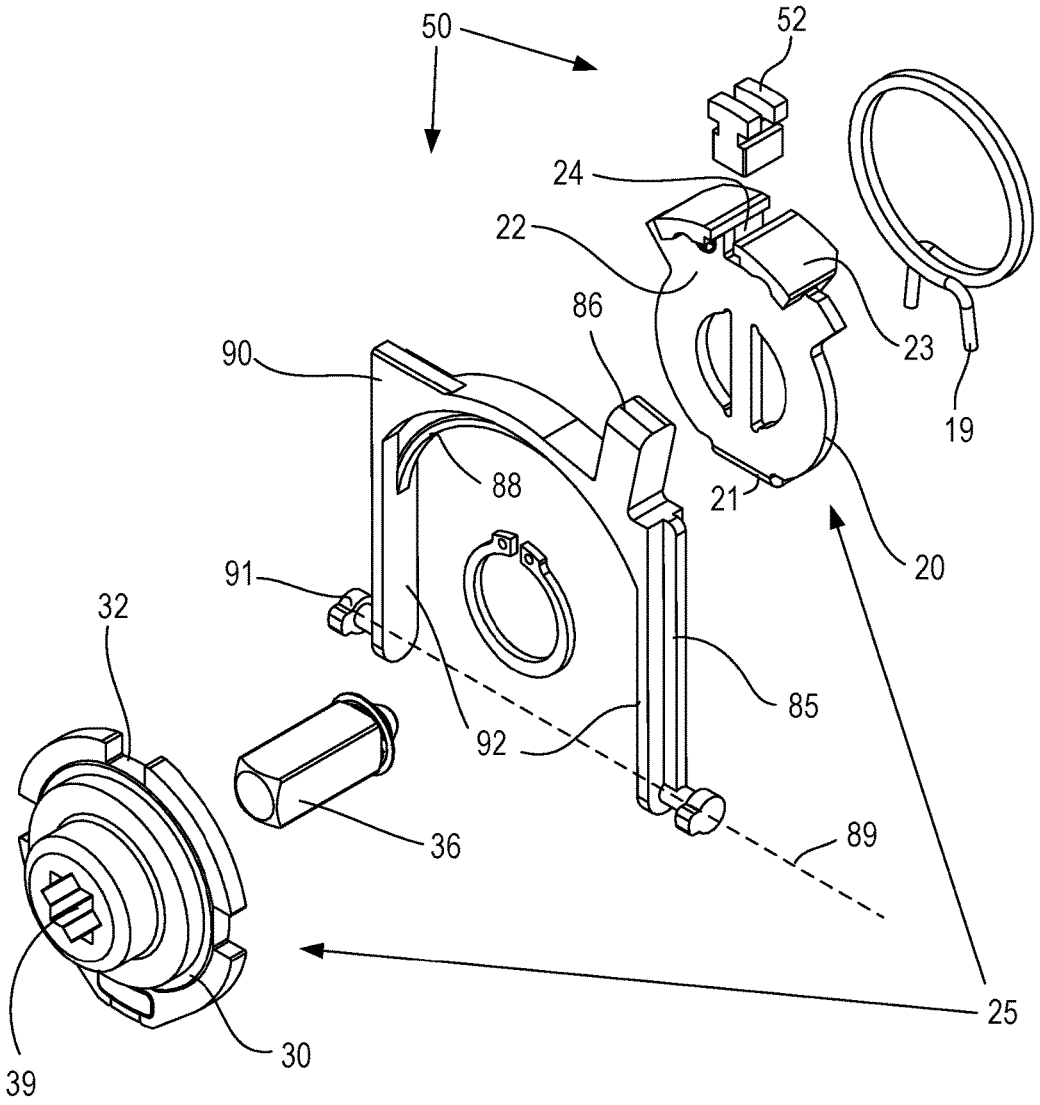
FIG. 6 is an exploded view of a clutch, spindle, spindle driver, and handle coupler.
Figure 7:
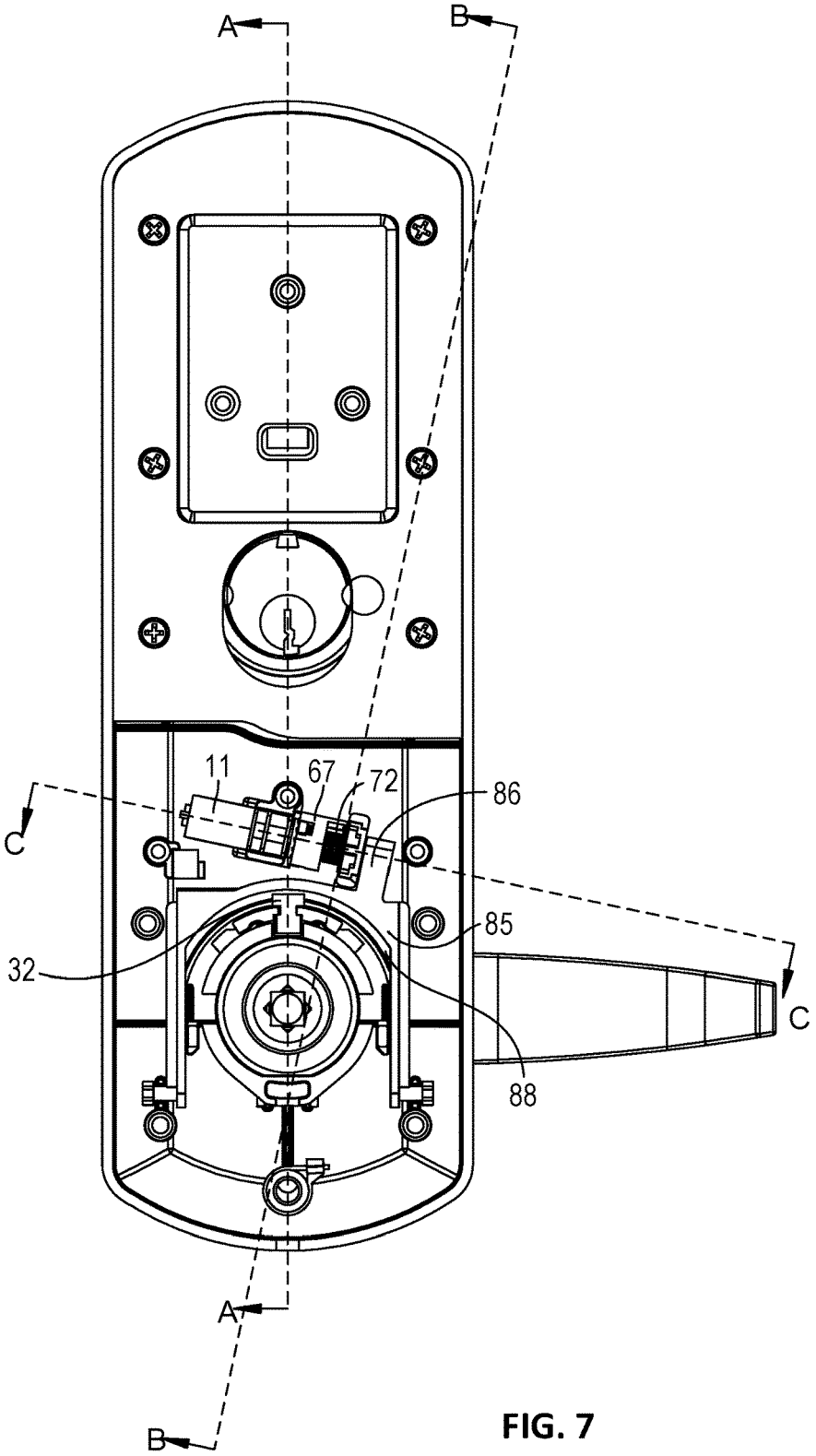
FIG. 7 is a plan view of the lock trim assembly with the clutch engaged.
Figure 8:
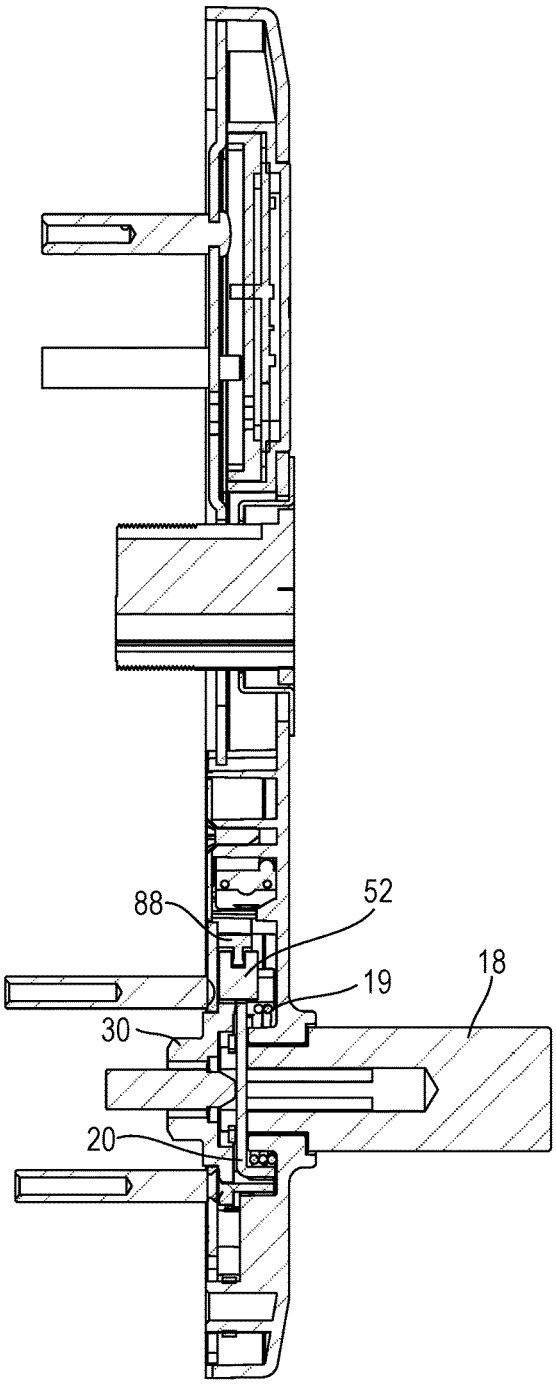
FIG. 8 is a section view of lock trim assembly along section A-A of FIG. 7 when the clutch is engaged.
Figure 9:
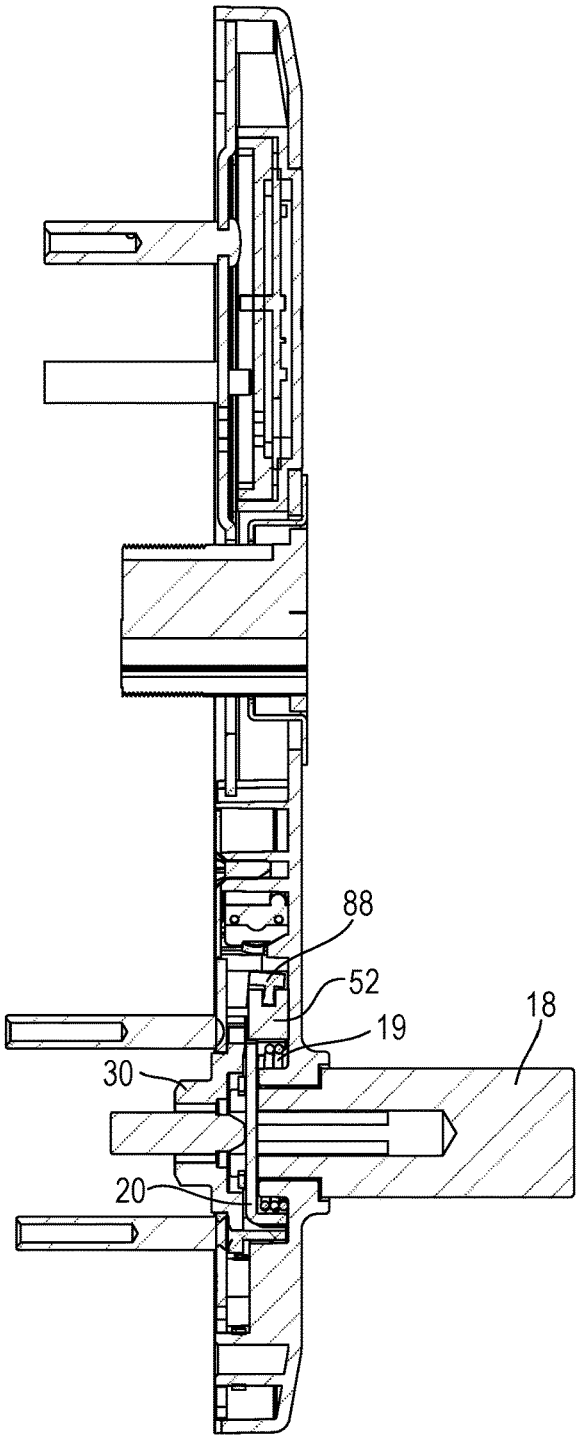
FIG. 9 is a section view of lock trim assembly along section A-A of FIG. 7 when the clutch is disengaged.
Figure 10:
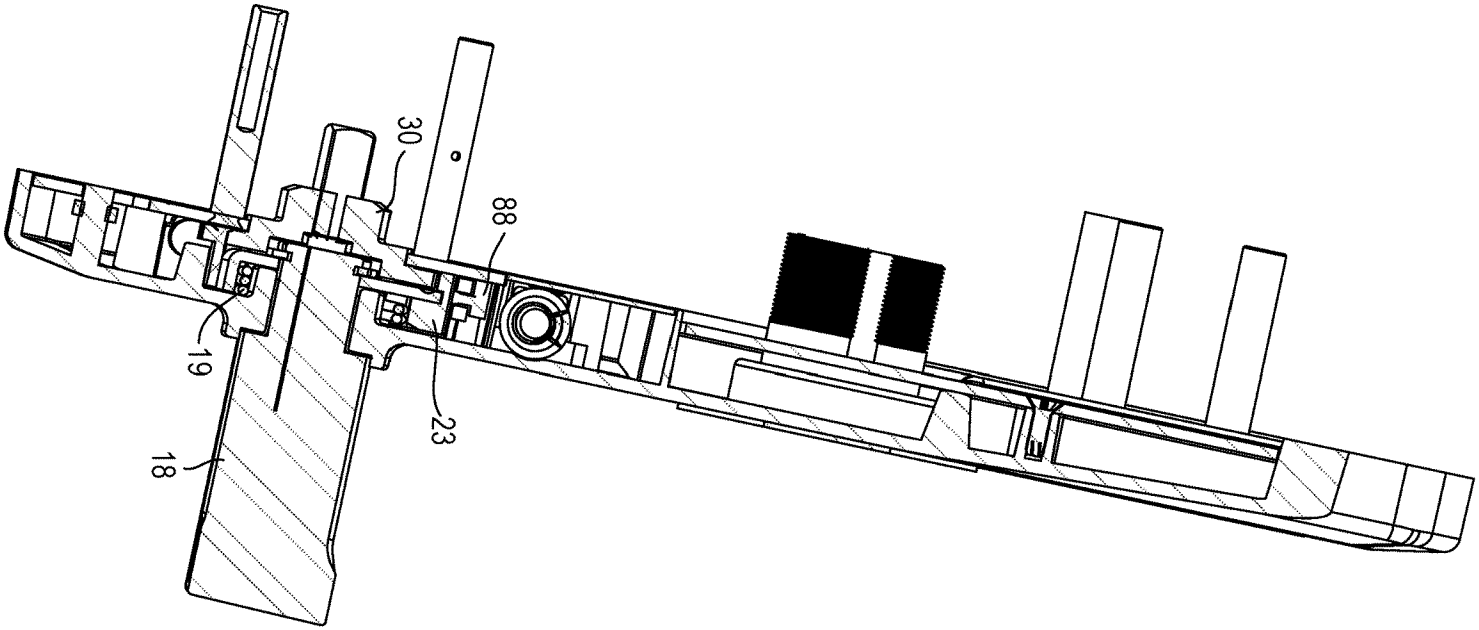
FIG. 10 is a section view of the lock trim assembly along section B-B of FIG. 7.
Figure 11:
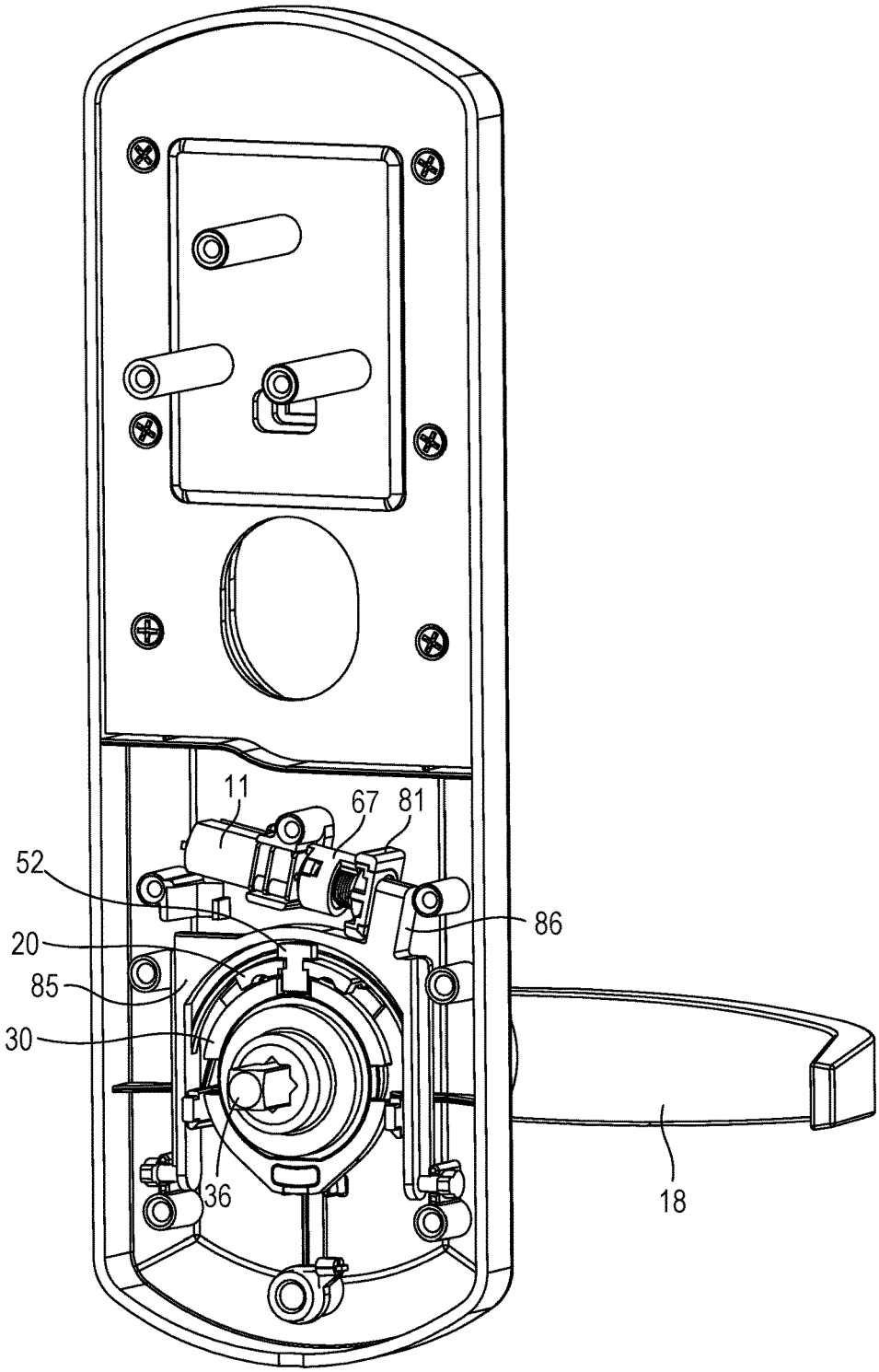
FIG. 11 is a perspective view of the lock trim assembly with the clutch engaged.
Figure 12:
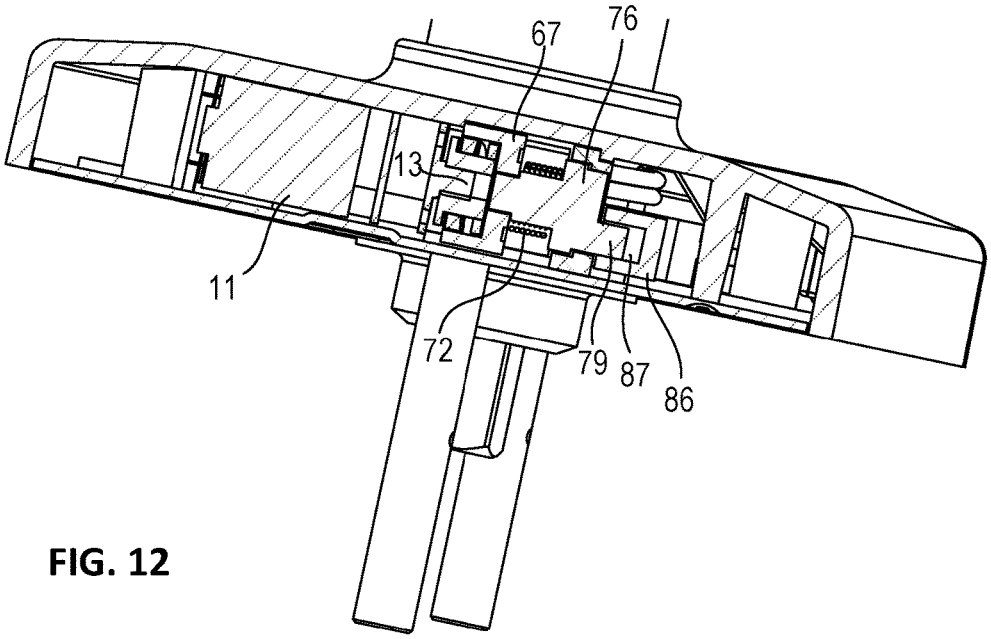
FIG. 12 is a section view of the clutch driver assembly along section C-C of FIG. 7 when the clutch is engaged.
Figure 13:
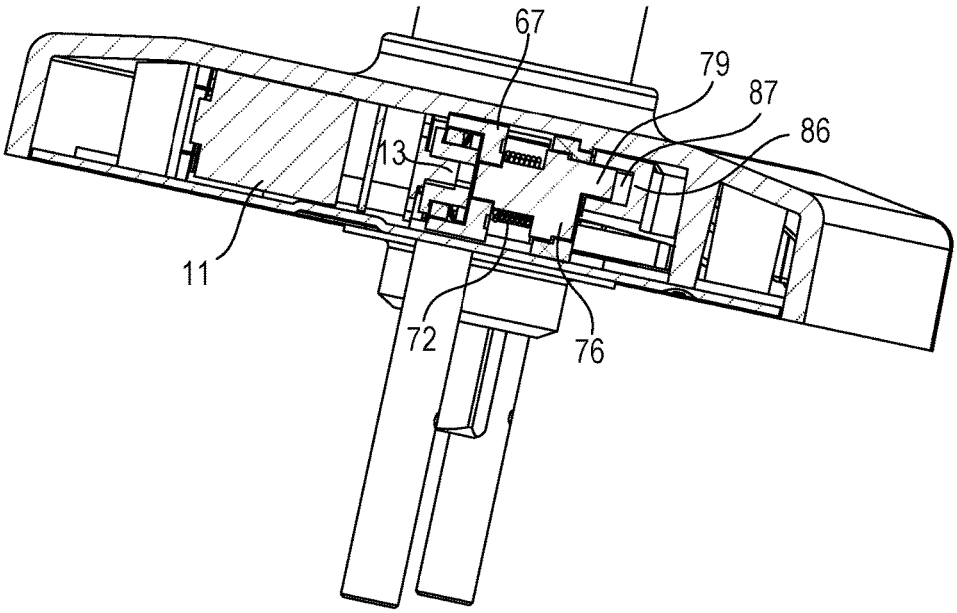
FIG. 13 is a section view of the clutch driver assembly along section C-C of FIG. 7 when the clutch is disengaged.
Figure 14:
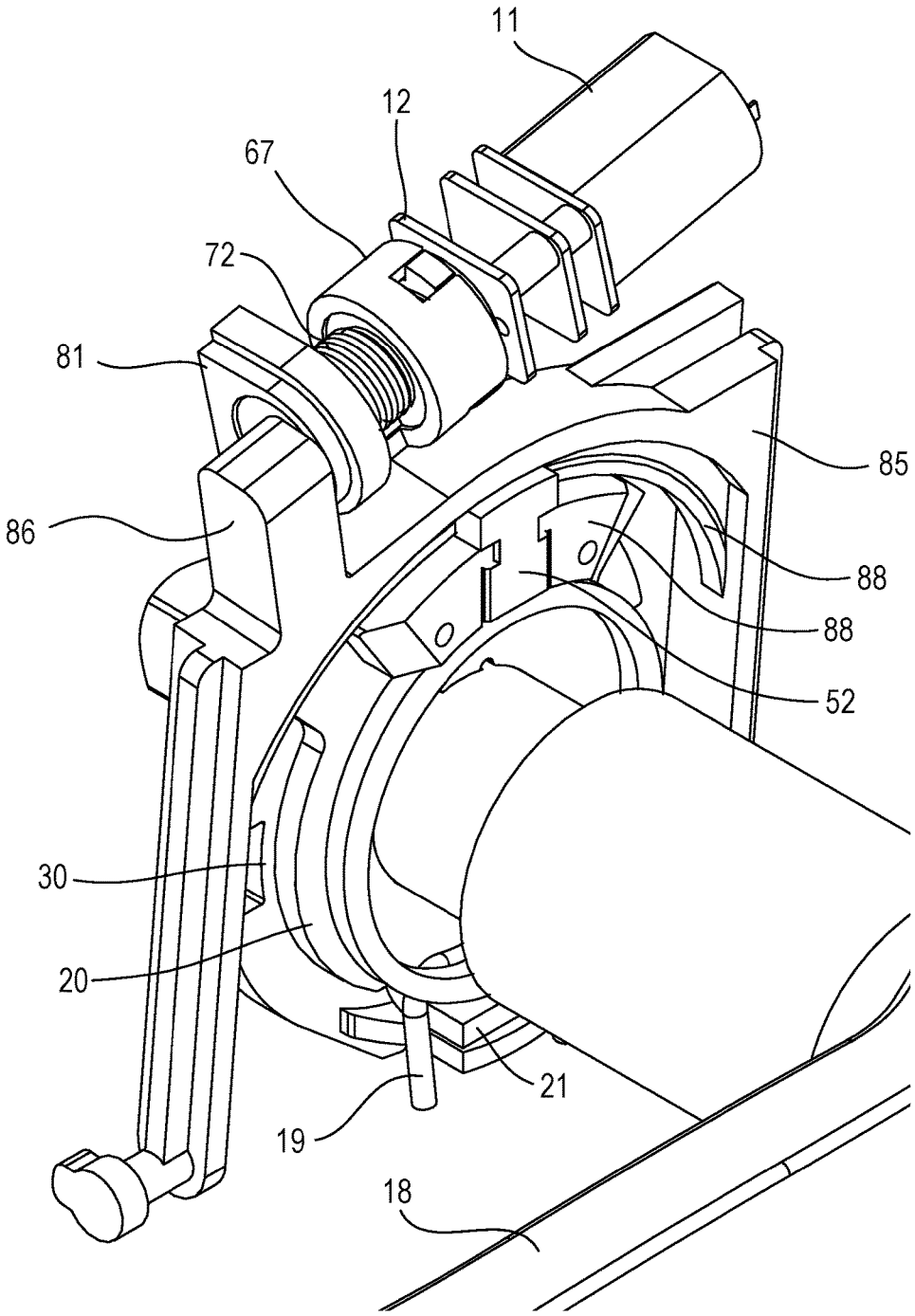
FIG. 14 is a perspective cut-away view of the clutch.
Figure 15:
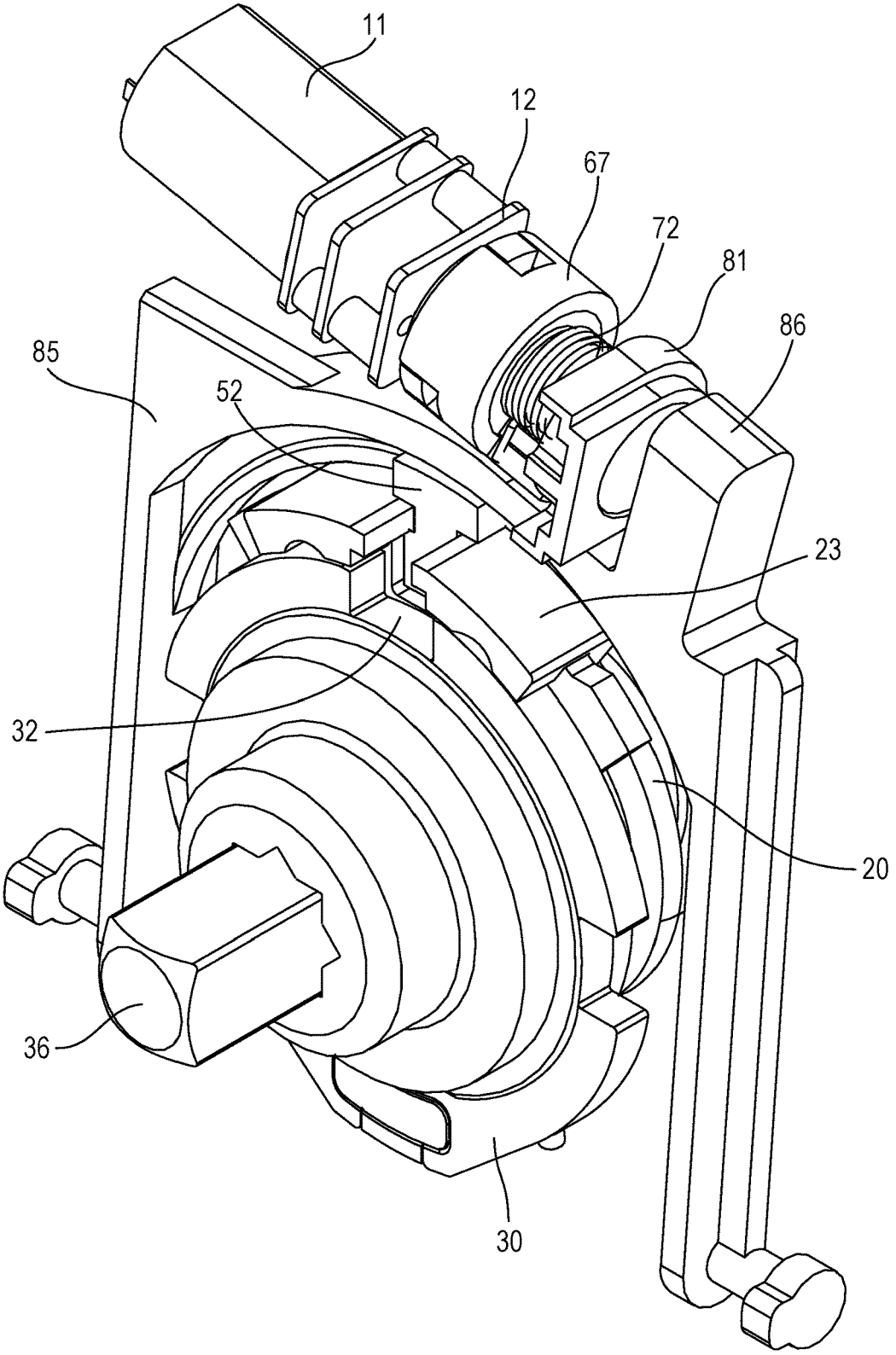
FIG. 15 is another perspective cut-away view of the clutch when the clutch is disengaged.
Figure 16:
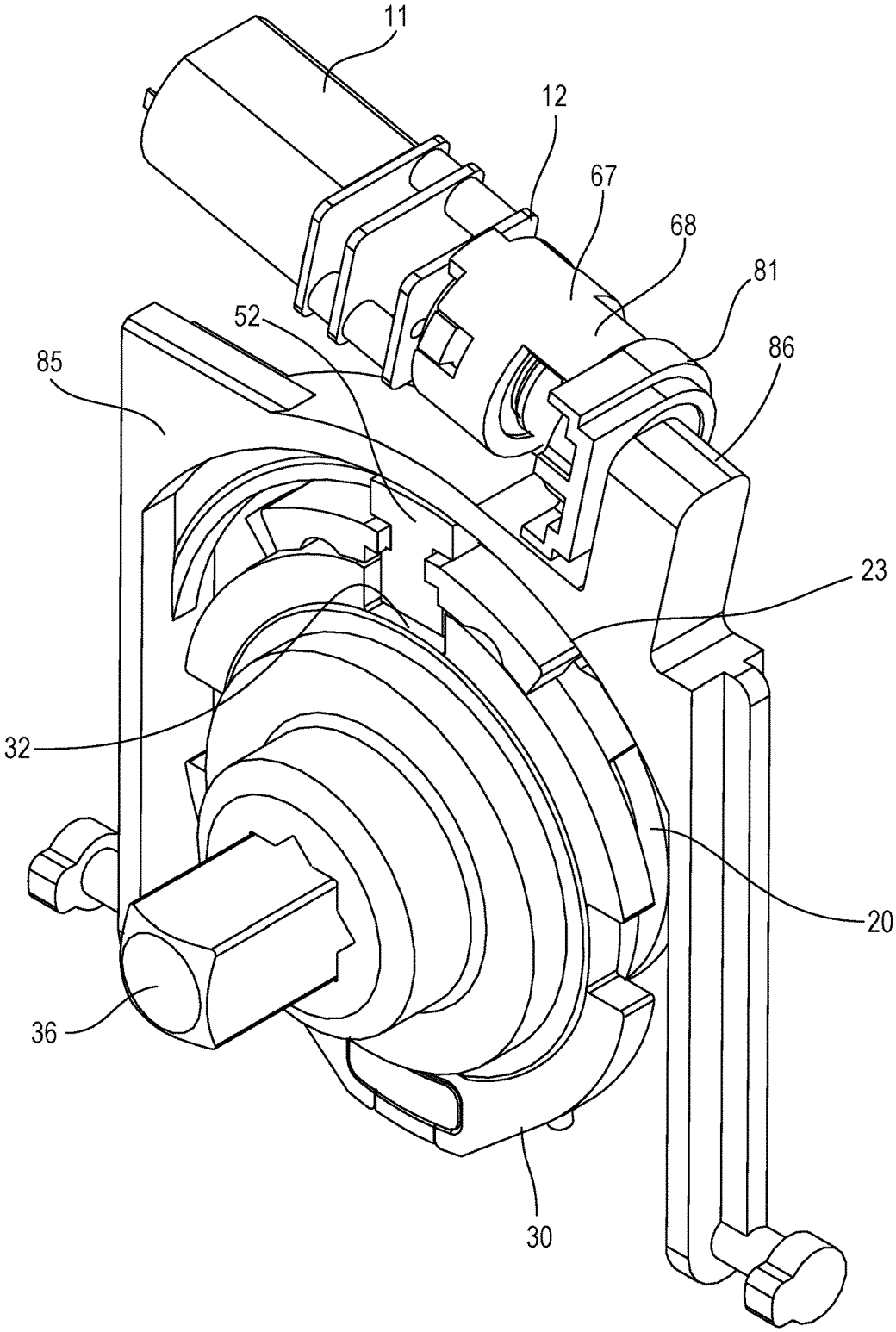
FIG. 16 is a perspective cut-away view of the clutch when the clutch is engaged.
Figure 17:
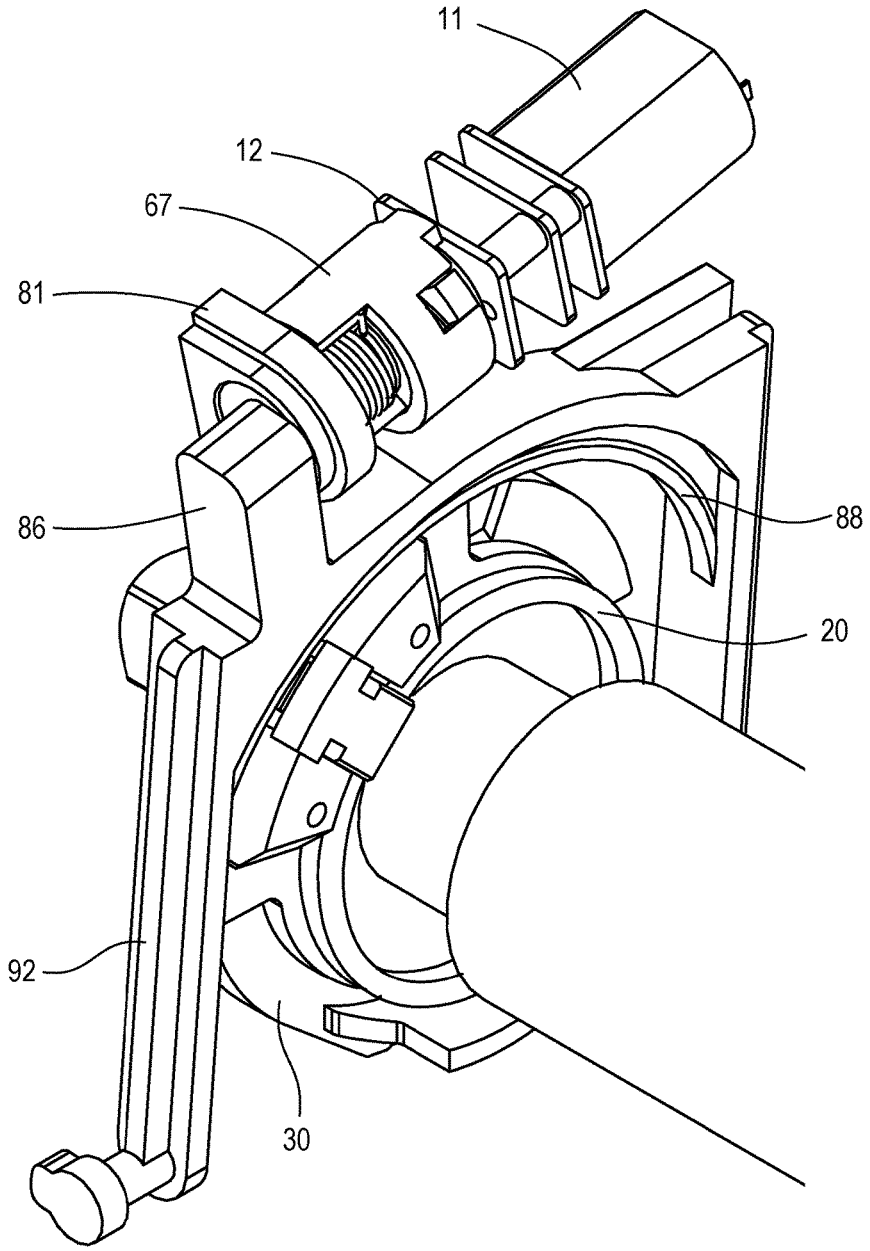
FIG. 17 is a perspective cut-away view of the clutch when the clutch is disengaged and in an escapement condition where the handle coupler is not aligned with the spindle driver.
Figure 18:
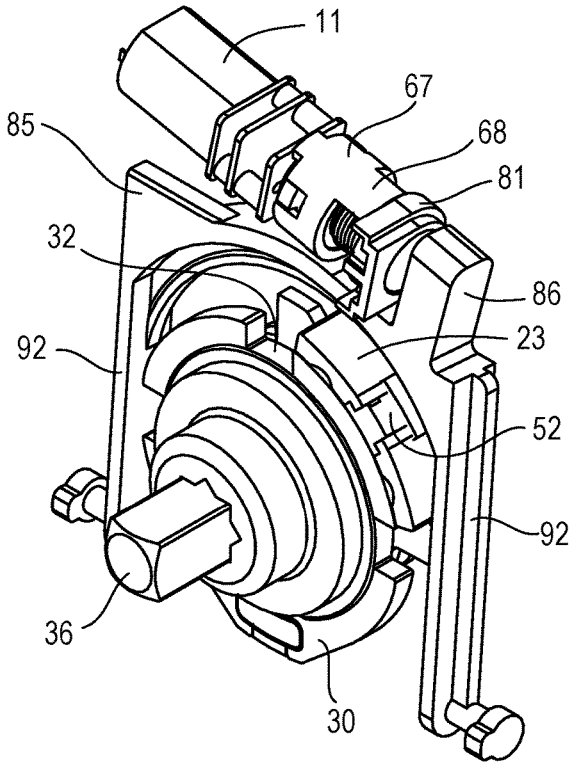
FIG. 18 is another perspective cut-away view of the clutch of FIG. 17.
Figure 19:
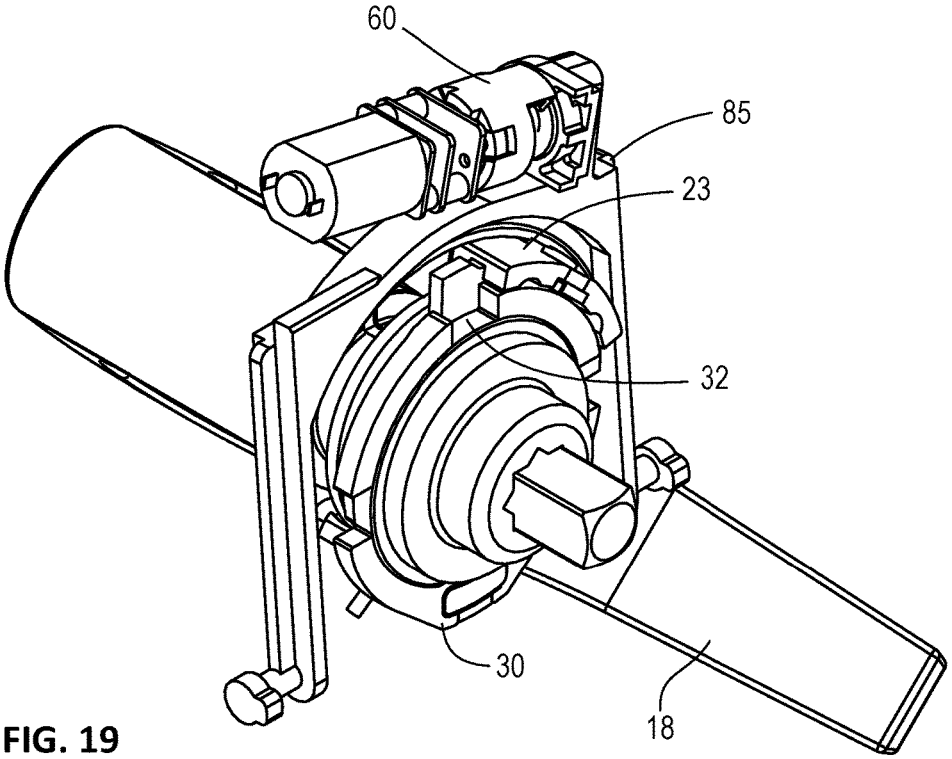
FIG. 19 is another perspective cut-away view of the clutch of FIG. 17.

As best illustrated in FIG. 6, the handle coupler 20 comprises a disk or flange 22 with guide shoulders 23 that constrain the handle coupler for axial rotation within the trim assembly 10. An axially extending slot 24 formed in the guide shoulders 23 guides a clutch member or connecting link 52 in a substantially axial direction between a first position where the connecting link 52 is positioned closest to a front face 16 of the escutcheon 14 and a second position where the connecting link 52 is positioned farthest away from the front face 16. The spindle driver 30 has a corresponding slot 32 operable to be aligned with the handle coupler slot 24, allowing it to receive a portion of the connecting link 52 when the connecting link 52 is in its second position. The handle coupler 20 also comprises a spring leg bracket 21 for mounting opposite legs of a return spring 19. Rotation of the handle coupler 20 pulls and/or pushes the legs of the return spring 19 apart, biasing the handle 18 back toward a neutral, non-latch-retracting position.

The connecting link 52 is operative for axial movement between an engaged configuration that engages the spindle driver 30 to the handle coupler 20 and a disengaged configuration in which the spindle driver 30 is disengaged from the handle coupler 20.

Framed more generally, the connecting link 52 is part of a clutch 50 that is operated by the motor 11 to translate the connecting link 52 to engage and disengage the handle coupler 20 to the spindle driver 30. The clutch 50 is operative to engage the handle coupler 20 to the spindle driver 30 when the spindle driver slot 32 is aligned with the handle coupler slot 24. In this configuration, the spindle driver 30 rotates with the handle coupler 20. However, when the spindle driver slot 32 is not aligned with the handle coupler slot 24, the clutch 50 is inoperative to engage the handle coupler 20 to the spindle driver 30. And in this disengaged configuration, rotation of the handle coupler 20 is not operative to rotate the spindle driver 30.

The motor 11 includes an upper face or bracket 12 and a shaft 13, and the shaft 13 is oriented perpendicular to the spindle 36. A clutch driver assembly 60, which can be more specifically characterized as a pin driver assembly, is mounted on the motor 11 and operative to rotate a cam or eccentrically-positioned offset pin 79 coupled to the clutch 50 between a clutch-coupling position and a clutch-decoupling position.

The clutch driver assembly 60 comprises an escapement spring 72 between first and second spring seats 67 and 76 capped by a motor assembly cap piece or sleeve retainer 81 for the second spring seat 76. The first spring seat 67 is coupled to either a shaft 13 for rigid rotation with the shaft 13 or to a slip clutch 62 (described further below) for rotation with the slip clutch 62. The escapement spring 72 is a helical torsion spring with two bent up spring legs 73, 74. Opposite legs 73, 74 of the escapement spring 72 straddle a spring leg saddle 68 of the first spring seat 67. The second spring seat 76 comprises a cylindrical pivot 78 that extends through the center of the escapement spring 72 and rides in a corresponding pivot seat of the first spring seat 67. A spring leg stop tab 77 extends axially from the body of the second spring seat 76.

The second spring seat 76 also serves as a carousel or carrier for a cam or pin, with a cam or an offset pin or post 79 being positioned eccentrically on the second spring seat 76. As the second spring seat 76 turns, the offset pin 79 rotates along a circular path that carries it between a clutch-coupling position, farthest from the escutcheon's exterior face 16, and a clutch-decoupling position, closest to the escutcheon's exterior face 16.

In one embodiment, the clutch 50 includes a rocker or pivot arm 85, driven by the offset pin 79, that carries the connecting link 52 from a coupling configuration to a decoupling configuration, and vice versa. The pivot arm 85 includes a pivot end 91 and a distal end 90. The pivot end 91 comprises two legs 68 that straddle the handle coupler 20 and spindle driver 30. The pivot arm 85 is pivotally mounted to the escutcheon 14 for operative movement between clutch-engaging and clutch-disengaging positions. The pivot arm 85 is constrained to pivot about an axis 89 perpendicular to the spindle 36.

The pivot arm 85 includes a pin receiver 86 along its distal end 90. The offset pin 76 cooperates with the pin receiver 86 to translate rotary motion of the offset pin 79 into substantially axial movement of the distal end 90 of the pivot arm 85. In one embodiment, the pin receiver 86 comprises an elongated slot or cavity 87 to accommodate the circular path of the offset pin 79.

The pivot arm 85 also provides an arcuate rail 88 configured to carry a connecting link 52. The rail 88 guides the connecting link 52 for radial movement, driven by the door handle 18, along the arcuate rail 88. In this manner, the connecting link 52 is also operative for synchronized radial movement with the handle 18.

The pivot arm 85 also guides the connecting link 52 for axial movement between a clutch-engaging position and a clutch-disengaging position. In the clutch-engaging position, the connecting link 52 bridges a first slot 32 in the spindle driver 30 and a second slot 24 in the handle coupler 20. In the clutch-disengaging position, the connecting link 52 is retracted toward the escutcheon's front face 16 so that the connecting link 52 does not engage the first slot 32.

The clutch driver assembly 60 is operative under a non-escapement condition and at least a first escapement condition. The first escapement condition is characterized by an attempt to engage the clutch 50 when the spindle driver slot 32 is not aligned with the handle coupler slot 24. Until alignment is restored, the connecting link 52 is blocked from extending into the spindle driver slot 32.

Movement of the handle coupler 20 into alignment with the spindle driver 30 lines the connecting link 52 up with the spindle driver slot 32. Once aligned, the stored energy of the escapement spring 72 rotates the second spring seat 76, extending the connecting link 52 into the spindle driver slot 32—that is, the coupling configuration—thus enabling the handle 18 to retract the latch.

A second escapement condition is characterized by an attempt to disengage the clutch 50 while the handle 18 is rotated away from a neutral, non-latch-retracting orientation. The asymmetry of the load exerted on the connecting link 52 may have a binding effect, preventing the connecting link 52 from retracting into the handle coupler slot 24. Once the lever is returned to its neutral, non-latch-retracting position, the connecting link 52 is freed to fully retract into the handle coupler slot 24.

In the non-escapement condition, by contrast, a spring leg stop tab 77 of the second spring seat 76 stays in substantial alignment with the spring leg saddle 68 of the first spring seat 67, and the second spring seat 76 is operative under a biasing force of the escapement spring 72 to rotate together with the first spring seat 67.

In either escapement condition, the spring leg stop tab 77 is blocked from rotating, thereby impeding movement of one of the legs 73, 74 of the escapement spring 72. Operation of the motor 11 in either escapement condition causes the spring leg saddle 68 to push against the opposite of the legs 74, 73, winding up and storing energy in the escapement spring 72. Once the connecting link 52 is free to travel between clutch-coupling and clutch-decoupling positions, the stored-up energy of the wound-up escapement spring 72 is released into the second spring seat 76, causing the second spring seat 76 to rotate until the spring leg stop tab 77 is re-aligned with the spring leg saddle 68.

The clutch driver assembly 60 optionally comprises a slip clutch or coupler 62 mounted to the motor 11. The slip clutch 62 comprises a keyhole 63 for receiving the motor shaft 13, a stationary portion 64 mounted to the motor bracket 12, and a carousel 65 driven by the motor shaft 13. Carousel couplers 66 couple the first spring seat 67 to the carousel 65 for synchronized rotation therewith. The slip clutch 62 accommodates a stronger (lower geared) motor 11. If the spring seats 67, 76 of the clutch driver assembly 60 are blocked from rotating, then once the torque exerted on the motor shaft 13 exceeds a threshold, the connection between the shaft 13 and the carousel 65 slips, preventing damage to the motor 11.

It should be noted that several different types of motors 11 are suitable for use with the present invention. In one embodiment, a stepper motor is used. In another embodiment, gear motor is used in conjunction with an over torque clutch 62.

The offset pin 79, pivot arm 85, and escapement spring 72 are respectively arranged so that if the spindle driver 30 rotates from a position in which the spindle driver slot 32 is not aligned with the connecting link 52 to a position in which the spindle driver slot 32 is aligned with the connecting link 52, the biasing of the escapement spring 72 pushes the connecting link 52 into the spindle driver slot 32.

Another advantage of the present invention is that when the offset pin 79 is rotated to the clutch-decoupling position, the pivot arm 85 is at its farthest position away from the door, rendering the trim assembly 10 more effective at thwarting attempts to manipulate the clutching function using an impact or a magnet.

All of the aforementioned prior art references are herein incorporated by reference for all purposes.

It should be noted that the embodiments illustrated and described in detail herein are exemplary only, and that various other alternatives, adaptations, and modifications may be made within the scope of the present invention. Accordingly, the present invention is not limited to the specific embodiments illustrated herein, but is limited only by the following claims.

I claim:

1. A door trim assembly with a clutch mechanism for operating a door latch, the door trim assembly comprising:

a handle coupler configured to be coupled to and rotated with an outside door handle/lever, the handle coupler having a first coupling contact area;

a spindle driver with a second coupling contact area;

a movable coupler operative to selectively couple the handle coupler to, and decouple the handle coupler from, the spindle driver when the first and second coupling contact areas are aligned to seat the movable coupler, wherein:

when the handle coupler and spindle driver are aligned, the movable coupler is operable to move between coupling and decoupling configurations in which the handle coupler is respectively coupled to, and decoupled from, the spindle driver;

when the movable coupler is in the coupling configuration, rotation of the outside handle/lever results in unisonant rotation of the handle coupler and spindle driver to retract the door latch;

when the movable coupler does not couple the handle coupler to the spindle driver, rotation of the outside handle/lever rotates the handle coupler rotates freely of the spindle driver;

a motor; and a drive linkage operated by the motor to drive the movable coupler between the coupling and decoupling configurations;

wherein the drive linkage comprises a spring coupled with the motor for being turned and loaded by the motor;

wherein the motor is operable to load the spring when the first and second coupling contact areas are not aligned; and wherein when the first and second coupling contact areas are realigned, the spring, when loaded, is operable to drive the movable coupler into the coupling configuration via pivotal movement of the moveable coupler.

2. The door trim assembly of claim 1, wherein the driver linkage comprises a spring leg saddle and a tab that rotate about a common axis with the motor shaft, and wherein opposite legs of the spring straddle the spring leg saddle and tab.

3. The door trim assembly of claim 2, wherein:

in a first condition, the spring leg saddle is aligned with the tab and the driver linkage is operable to rotate the spring leg saddle synchronously with the tab; and in a second condition, the tab is blocked from rotating, and the drive linkage is operable to rotate the spring leg saddle away from the tab, thereby loading the spring.

4. The door trim assembly of claim 1, wherein the drive linkage further comprises a carousel, a pin or a cam, and a rocker or pivot arm, wherein the carousel is operative to turn the pin or cam to move the rocker or pivot arm to drive the movable coupler into the coupling or decoupling configuration.

5. The door trim assembly of claim 1, further comprising a pin-carrying or cam-carrying carousel that converts motor-driven rotary motion into linear motion, wherein the drive linkage is configured to store energy in the spring when non-alignment of the handle coupler to the spindle driver blocks the carousel from rotating, and to release energy from the spring by rotating the carousel.

6. The door trim assembly of claim 5, further comprising a slip clutch mounted to the motor that causes a connection between the motor shaft and the carousel to slip when an amount of torque that the motor applies exceeds a threshold.

7. A door trim assembly with a clutch mechanism for operating a door latch, the door trim assembly comprising:

a handle coupler configured to be coupled to and rotated with a door handle/lever;

a spindle driver;

a movable coupler configured to selectively couple the handle coupler to the spindle driver so that they rotate in unison together, and the movable coupler selectively decouple the handle coupler from the spindle driver so that the handle coupler rotates freely of the spindle driver;

a pivot arm adapted to be attached to the movable coupler so that the pivot arm pivots to carry the moveable coupler between coupling and non-coupling configurations; and a motor that drives a link attached to the pivot arm to pivot the pivot arm and the moveable coupler it carries between the coupling and non-coupling configurations.

8. The door trim assembly of claim 7, further comprising an escutcheon with an outside face, wherein the movable coupler is moved into the coupling configuration by positioning the link a maximum distance from the outside face of the escutcheon.

9. The door trim assembly of claim 8, wherein the the movable coupler is maintained in the non-coupling configuration by positioning the link a minimum distance from the outside face of the escutcheon.

10. The door trim assembly of claim 7, further comprising a spring seated on first and second spring seats that are positioned between the motor and the link, wherein energy is stored in the spring or released from the spring by rotating the first spring seat relative to the second spring seat.

11. The door trim assembly of claim 10, wherein in a first condition, the second spring seat is blocked from rotation and the first spring seat is operative to rotate and store energy in the spring while the second spring seat is blocked.

12. The door trim assembly of claim 11, wherein in a second condition, the second spring seat is free to rotate and the spring's stored energy, if any, is operative to move the pivot arm into the coupling configuration.

13. A door trim assembly with a clutch mechanism for operating a door latch, the door trim assembly comprising:

a handle coupler configured to be coupled to and rotated with a door handle/lever, the handle coupler having a first coupling contact area;

a spindle driver operable to drive a spindle to retract the door latch, the spindle driver having a second coupling contact area;

a movable coupler configured to selectively couple the handle coupler to, and decouple the handle coupler from, the spindle driver when the first and second coupling contact areas are aligned, wherein when coupled, the spindle driver rotates in unison with the handle coupler, wherein when decoupled, the handle coupler rotates freely of the spindle driver, and wherein non-alignment of the first and second coupling contact areas blocks the movable coupler from coupling the handle coupler to the spindle driver;

a motor-operated driver assembly comprising:

a spring mounted between first and second spring seats;

a motor operable to rotate the first spring seat;

the second spring seat being coupled to the movable coupler;

the second spring seat being biased by legs of the spring to be rotated with the spring to urge the movable coupler to couple the handle coupler to, and decouple the handle coupler from, the spindle driver via pivotal movement of the moveable coupler; and the first spring seat being operable to load the spring when the second spring seat is blocked from rotating;

wherein stored energy of the spring is operable to rotate the second spring seat when the first spring seat is no longer blocked from rotating.

14. The door trim assembly of claim 13, wherein a cam is eccentrically positioned on the second spring seat, the cam operating to convert rotary motion of the second spring seat into substantially linear movement of the movable coupler.

15. The door trim assembly of claim 13, wherein a pin is eccentrically positioned on the second spring seat, the pin operating to convert rotary motion of the second spring seat into substantially linear movement of the movable coupler.

16. The door trim assembly of claim 13, wherein opposite legs of the spring straddle a spring leg saddle of the first spring seat.

17. The door trim assembly of claim 13, further comprising an escutcheon, wherein the handle coupler comprises a disk mounted for coaxial rotation with the spindle and a guide or slot for linearly guiding a cam or pin mounted on the second spring seat in an axial direction between a first position closest to an outside face of the escutcheon and a second position farthest from the outside face of the escutcheon.

18. The door trim assembly of claim 17, wherein the first and second coupling contact areas are slots operable to be aligned with each other to receive the movable coupler to engage the spindle driver to the handle coupler.

19. A door trim assembly with a clutch mechanism for operating a door latch, the door trim assembly comprising:

an escutcheon;

a handle coupler configured to be coupled to and rotated with a door handle/lever, the handle coupler having a first slot;

a spindle driver operable to drive a spindle to retract the door latch, the spindle driver having a second slot;

a movable coupler configured to selectively bridge the first and second slots when the first and second slots are aligned, wherein when the slots are bridged, the spindle driver rotates in unison with the handle coupler, wherein when the slots are not aligned, the handle coupler rotates freely of the spindle driver, and the movable coupler is blocked from moving from a decoupling to a coupling configuration;

a pivot arm pivotally mounted to the escutcheon;

the pivot arm including an arcuate rail configured to carry the movable coupler and guide the connecting link for radial movement along the arcuate rail;

a motor-operated driver assembly comprising:

a spring mounted between first and second spring seats;

a motor operable to rotate the first spring seat;

the second spring seat being coupled to the pivot arm;

the second spring seat being biased by legs of the spring to move the pivot arm to couple the handle coupler to, and decouple the handle coupler from, the spindle driver; and the first spring seat being operable to load the spring when the second spring seat is blocked.

20. The door trim assembly of claim 19, wherein the offset pin, pivot arm, and spring are respectively arranged so that if the spindle driver rotates from a position in which the spindle driver slot is not aligned with the connecting link to a position in which the spindle driver slot is aligned with the connecting link, the biasing of the spring pushes the connecting link into the spindle driver slot.

* * * * *